US009134090B1

(12) United States Patent
Park

(10) Patent No.: US 9,134,090 B1
(45) Date of Patent: Sep. 15, 2015

(54) SPLIT TYPE MAGAZINE OF AIR RIFLE

(71) Applicant: Seung-Cheol Park, Bucheon-Si (KR)

(72) Inventor: Seung-Cheol Park, Bucheon-Si (KR)

( * ) Notice: Subject to any disclaimer, the term of this patent is extended or adjusted under 35 U.S.C. 154(b) by 0 days.

(21) Appl. No.: 14/743,969

(22) Filed: Jun. 18, 2015

(30) Foreign Application Priority Data

Apr. 14, 2015 (KR) ..... 10-2015-0052149

(51) Int. Cl.
*F41B 11/00* (2013.01)
*F41B 11/54* (2013.01)
*F41B 11/55* (2013.01)
*F41A 9/73* (2006.01)

(52) U.S. Cl.
CPC . *F41B 11/54* (2013.01); *F41A 9/73* (2013.01); *F41B 11/55* (2013.01)

(58) Field of Classification Search
CPC ..... F41B 11/54; F41B 11/55; F41A 9/73
USPC ..... 124/48, 51.1, 52, 66, 67, 74
See application file for complete search history.

(56) References Cited

U.S. PATENT DOCUMENTS 2,962,017 A * 11/1960 Horowitz et al. ..... 124/27
3,913,553 A * 10/1975 Braughler et al. ..... 124/73
4,422,433 A * 12/1983 Milliman ..... 124/74
4,986,251 A * 1/1991 Lilley ..... 124/67
4,993,400 A * 2/1991 Fitzwater ..... 124/48
5,150,701 A * 9/1992 Wackrow et al. ..... 124/67
5,186,156 A * 2/1993 Clayton ..... 124/59
5,205,270 A * 4/1993 Szente ..... 124/50
5,660,159 A * 8/1997 Clayton ..... 124/66
5,680,853 A * 10/1997 Clayton ..... 124/66
5,845,629 A * 12/1998 Ratliff ..... 124/56
6,470,871 B2 * 10/2002 Casas-Salva ..... 124/48
6,488,019 B2 * 12/2002 Kotsiopoulos ..... 124/51.1
6,530,368 B1 * 3/2003 Maeda et al. ..... 124/48
6,688,298 B2 * 2/2004 Maeda et al. ..... 124/48
6,729,322 B2 * 5/2004 Schavone ..... 124/72
6,745,755 B2 * 6/2004 Piccini ..... 124/49
6,752,137 B2 * 6/2004 Brunette et al. ..... 124/74
6,796,300 B2 * 9/2004 Petrosyan et al. ..... 124/48
6,820,608 B2 * 11/2004 Schavone ..... 124/74
6,874,492 B1 * 4/2005 Schavone ..... 124/31
7,025,052 B2 * 4/2006 Schavone ..... 124/74
7,395,763 B1 * 7/2008 Vari ..... 102/529
7,963,280 B2 * 6/2011 Maeda ..... 124/48
8,402,958 B2 * 3/2013 Victor et al. ..... 124/45
8,931,467 B2 * 1/2015 Lee ..... 124/56
2003/0056778 A1 * 3/2003 Schavone ..... 124/74
2011/0186027 A1 * 8/2011 Casas Salva ..... 124/74
2013/0008421 A1 * 1/2013 Lee ..... 124/71

FOREIGN PATENT DOCUMENTS

KR 10-2001-0026459 A 4/2001

* cited by examiner

*Primary Examiner* — Alexander Niconovich
(74) *Attorney, Agent, or Firm* — IM IP Law PLLC; C. Andrew Im

(57) ABSTRACT

A split type magazine of an air rifle includes a lock unit to prevent the rotation of a pellet rotating and conveying unit, A magazine body and a magazine fixing block of the split type magazine are divided from each other. The split type magazine allows the user to separate the magazine without moving the breechblock. It is safe because the pellet is not loaded in the chamber when the user inserts the magazine into the rifle body. Further, the lock unit of the pellet rotating and conveying unit enhances safety because the pellet rotating and conveying unit is locked when the magazine is separated.

4 Claims, 4 Drawing Sheets

(PRIOR ART)

SPLIT TYPE MAGAZINE OF AIR RIFLE

RELATED APPLICATIONS

This application claims priority from Korean Patent Application No. 10-2015-0052149 filed Apr. 14, 2015, which is herein incorporated by reference in its entirety.

BACKGROUND OF THE INVENTION

1. Field of the Invention

The present invention relates to a split type magazine of an air rifle, and more particularly, to a split type magazine of an air rifle which includes a pellet rotating and conveying lock unit for preventing rotation of a pellet rotating and conveying unit and of which a magazine body and a magazine fixing block are divided from each other.

2. Background Art

In general, an air rifle is a kind of gun to fire a pellet with pneumatic pressure of compressed air and is mainly used for the purpose of hunting or shooting sports because it is weaker in power than guns which use gunpowder.

Because the air rifles are safer than the guns which use gunpowder and require simple safety facilities which must be equipped in shooting ranges, air rifles have been relatively widely used in many countries for the purpose of leisure activities or sports.

A spring type air rifle which is a kind of the air rifle adopts a method that makes compressed air by pushing a piston inside a cylinder using elasticity to return a compressed spring to its original state and fires a pellet using the power. Such spring type air rifles are mainly used in replica guns which use 6 mm BB bullets. Such a spring type air rifle has several disadvantages in that a user has to compress the spring with his or her own power whenever the user fires and in that the air rifle generates additional recoil in addition to the recoil caused by reaction of a shot while the spring returns to its original state.

Next, a pump type air rifle compresses air by a pump hung on the rifle, stores the compressed air in a cylinder, and then, opens the compressed air at the time of an outburst so as to shoot a pellet with the power. Like the spring type air rifle, the pump type air rifle also has a disadvantage in that the user has to compress air by human effort using a lever whenever shooting. Before compressed air type air rifles, air rifles for competition mainly feature the pump type air rifles.

Next, a carbon dioxide type air rifle shoots a pellet with pressure generated while liquid carbon dioxide is vaporized. Because a cylinder is previously charged with carbon dioxide, the carbon dioxide type air rifle is more convenient than the spring type or pump type air rifle that the user has to compress air with the hand whenever shooting. However, the carbon dioxide type air rifle has a disadvantage in that hit is not uniform because pressure generated at the time of evaporation of gas is greatly influenced by ambient temperature.

Next, a compressed air type air rifle shoots a pellet by compressed air used for diving or compressed air which previously charged in the cylinder using an air compressor. The compressed air type air rifle varies little from the carbon dioxide type air rifle in appearance. Because there is no need to compress air manually whenever the user shoots a pellet, the compressed air type air rifle has convenience in use like the carbon dioxide type air rifle. However, the compressed air type air rifle is uniform in hitting differently from the carbon dioxide type air rifle. Now, air rifles for competition mainly feature the compressed air type air rifles.

Differently from bullets fired by gunpowder, pellets used in the air rifle is in the form that just a warhead exists without any cartridge case, because the pellets gain momentum necessary for firing the bullets not from gunpowder contained in the pellet but from the compressed air. The tail section of the pellets used in the air rifle is made into the form of a skirt in order to effectively receive power of compressed air.

In an aspect of materials of the pellet, in order to be less susceptible to wind resist, the pellets are mainly made of lead which is heavy metal. Representatively, there are pellets of 4.5 mm caliber, 5.0 mm caliber, 5.5 mm caliber and 6.35 mm caliber, and the pellets of 4.5 mm caliber are mainly used for competition, and the pellets of 5.5 mm caliber which is relatively strong in power are used for hunting.

Such air rifles are divided into single-shot rifles and multi-shot rifles.

Korean Patent Laid-open Publication No. 10-2001-0026459 discloses an example of the multi-shot air rifles.

As shown in FIG. 1, in order to insert a magazine 2 into a magazine combining part 3 of a rifle body 1, after a user pushes a trigger assembly forward to back a breechblock 6 and inserts the magazine 2 into the magazine combining part 3 of the rifle body 1, when the user pulls the trigger assembly 5 back to move the breechblock 6 forward, a single pellet is loaded in a chamber 4. However, the conventional multi-shot air rifle has a disadvantage in that it has to fire the single pellet loaded in the chamber 4 when the user takes out the magazine 2 from the magazine combining part 3 of the rifle body 1.

PATENT LITERATURE

Patent Literature 1: Korean Patent Laid-open Publication No. 10-2001-0026459

SUMMARY OF THE INVENTION

Accordingly, the present invention has been made to solve the above-mentioned problems occurring in the prior arts, and it is an object of the present invention to provide a split type magazine of an air rifle which includes a magazine body having a pellet rotating and conveying lock unit for preventing rotation of a pellet rotating and conveying unit and a magazine fixing block divided from the magazine body so that just the magazine body is separated even though a breechblock moves forward, thereby removing inconvenience that a user unnecessarily loads and fires a pellet.

To accomplish the above object, according to the present invention, there is provided a split type magazine of an air rifle including: a magazine case which is formed in a cylindrical shape and includes an insertion groove formed in a lower end portion thereof to be fit to a magazine fixing block and a plurality of screw holes perforated at both sides; a left side plate which includes a plurality of holes to which bolts for fixing the magazine case are inserted, a magazine fixing shaft 23 formed at one side thereof, a protrusion part formed at a lower end portion of the magazine fixing shaft, a polygonal head part formed at an end of the magazine fixing shaft, a screw formed at an end portion of the magazine fixing shaft, and an inverted U-shaped groove formed at a lower end thereof; a pellet rotating and conveying unit which includes a boss part and a protrusion part inserted into the magazine fixing shaft of the left side plate, a spring support hole perforated in the boss part, a plurality of pellet insertion holes on which a plurality of pellets can be loaded and of which outer circumferential parts are opened; a right side plate which is attached by a plurality of bolts through the screw holes of the magazine case and includes a part formed at the front side thereof to cover a magazine fixing pin slide lock insertion part, an insertion groove formed at a lower end portion thereof and fit to the magazine fixing block, and a circular opening formed at the middle part thereof; a right inner plate which is inserted into the opening of the right side plate and includes a boss part formed at the left side thereof, a counter sink hole formed at the right side thereof, and an inverted 'U'-shaped groove formed at a lower end thereof; a magazine rotary shaft fixing member which is fit to the counter sink hole of the right inner plate and includes a hole perforated at a small diameter part thereof, a spring and a ball inserted into the hole, a screw hole formed in the middle part thereof, and a recess formed in the middle part thereof to be fit to the polygonal head part of the left side plate; a spring of which one end is fixed to the spring support hole of the boss part of the pellet rotating and conveying unit and of which the other end is fixed to the hole formed in the magazine rotary shaft fixing member; a bolt for fixing the magazine rotary shaft fixing member to the screw of the magazine fixing shaft of the left side plate; and a magazine fixing block which includes balls which are respectively disposed at both sides thereof and elastically supported by a spring to be inserted into the insertion groove of the magazine case, a plurality of bolts inserted into a plurality of holes formed in a magazine fixing part of a machine part to attach the magazine fixing block to the engine part, and a pole index fixed and assembled to the middle part thereof by a pin.

Furthermore, the magazine case includes a pellet rotating and conveying unit which is disposed at the front thereof and to which a pellet rotating and conveying unit fixing pin pressed by a slide lock button and a spring elastically supported by a spring and a ball is assembled.

Moreover, the magazine rotary shaft fixing member includes a plurality of spring fixing holes to control elasticity of the spring.

Additionally, when a breechblock pushes down the middle part of the pole index, the pole index advances in the clockwise direction so as to be in a next lock waiting state of the pellet rotating and conveying unit, and, in a case that there is a pellet, an upper wind of the magazine fixing block fixes the pellet to prevent the pellet from going over.

Compared with the conventional air rifles that the magazine is separated after the user retreats the breechblock, the split type magazine of an air rifle according to the present invention allows the user to separate the magazine without moving the breechblock.

Compared with the conventional air rifles which are dangerous in safety because a single pellet is loaded in the chamber when the user inserts the magazine, the split type magazine of an air rifle according to the present invention is safe because the pellet is not loaded in the chamber when the user inserts the magazine into the rifle body.

Additionally, compared with the conventional air rifles which are dangerous because a single pellet is loaded in the chamber when the user inserts the magazine, the split type magazine of an air rifle according to the present invention provides a safety device doubly because it includes the lock unit of the pellet rotating and conveying unit.

In addition, compared with the conventional air rifles which have to fire a pellet when the magazine is separated, the split type magazine of an air rifle according to the present invention enhances safety because the pellet rotating and conveying unit is locked when the magazine is separated.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
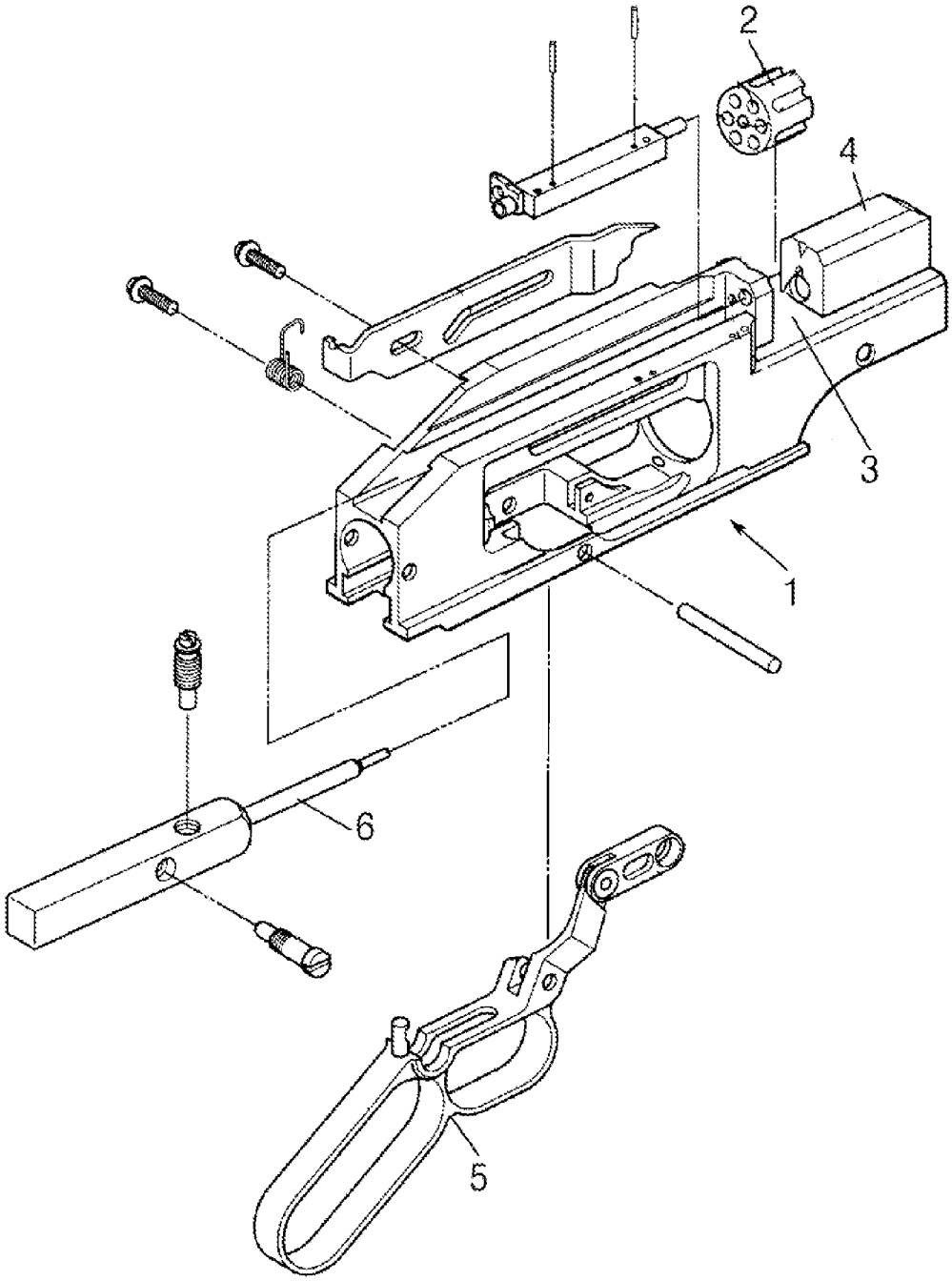
FIG. 1 is an exploded view of an air rifle body having a magazine according to a prior art.

Hereinafter, reference will be now made in detail to the preferred embodiment of the present invention with reference to the attached drawings. In the drawings, the same components have the same reference numerals even though they are illustrated in different figures.

After studying a device that a magazine is separated even though a breechblock advances in the direction of a chamber in order to solve the problems of the conventional air rifles, the inventor of the present invention has invented a split type magazine whose a magazine body could be separated from a magazine fixing block even in a state where the breechblock is inserted into a pellet insertion hole by forming a lower end part of the pellet insertion hole of a pellet rotating and conveying unit to be opened.

Figure 2:
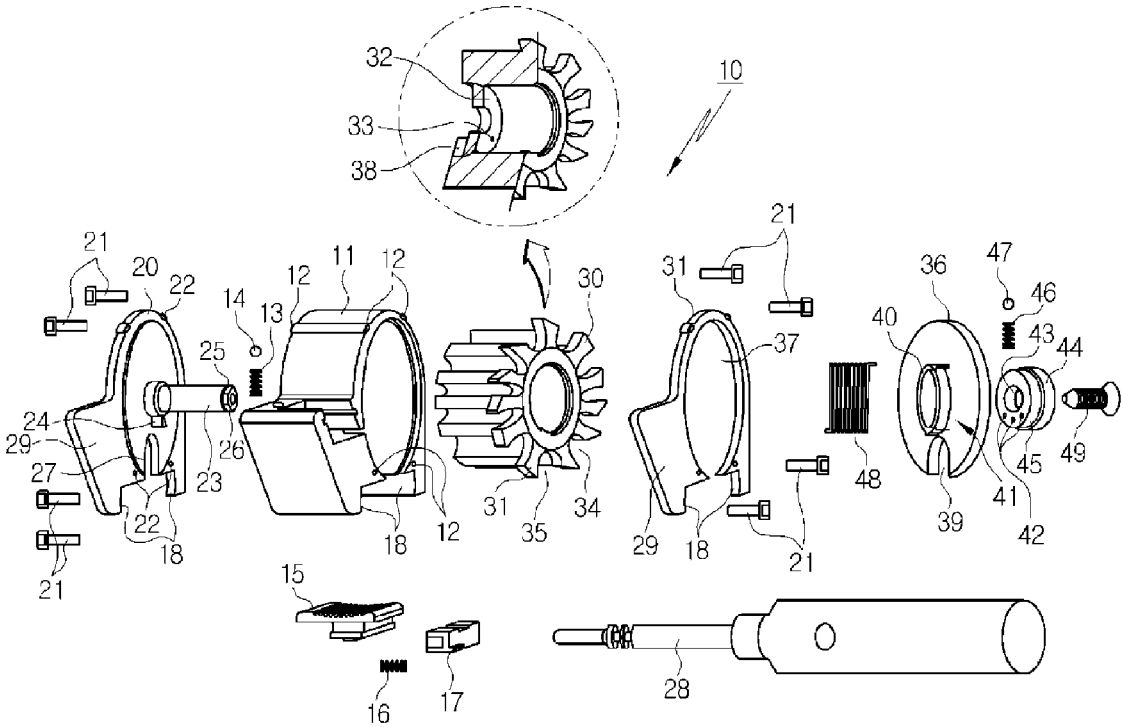
FIG. 2 is an exploded view of a magazine body having a lock unit for preventing rotation of a pellet rotating and conveying unit of a split type magazine of an air rifle according to the present invention, and for your reference, illustrates a breechblock.
Figure 3:
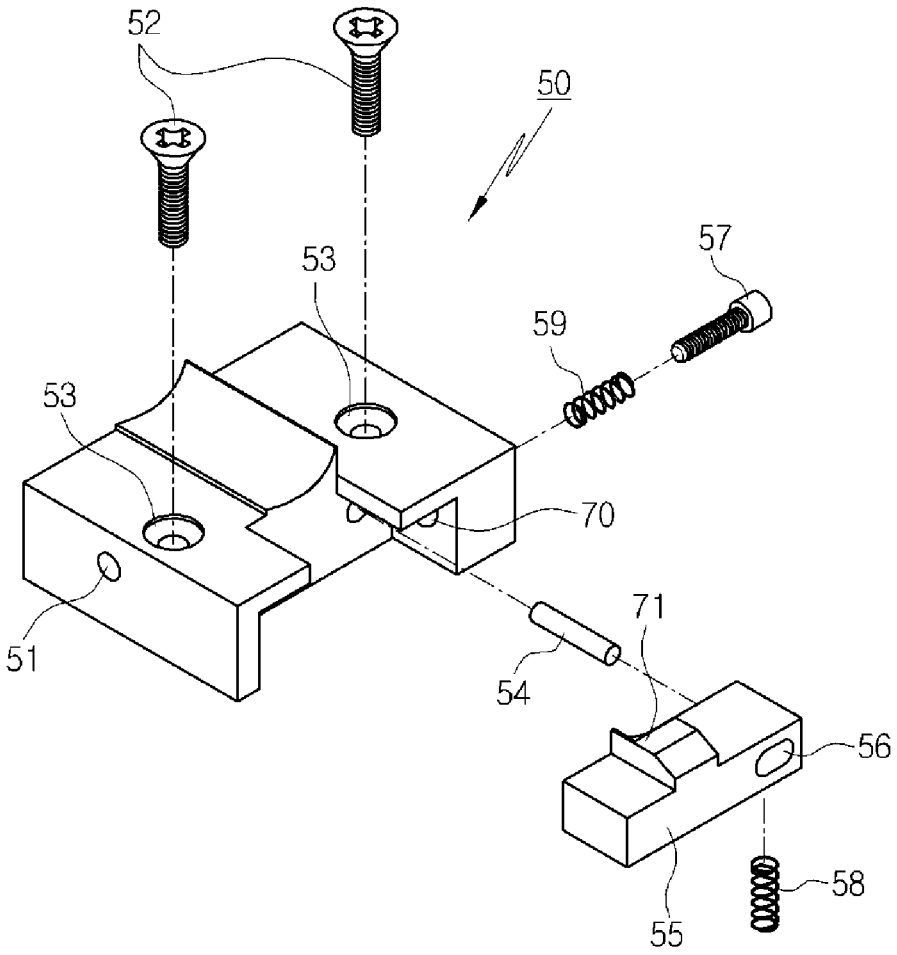
FIG. 3 is an exploded view of a magazine fixing block.
Figure 4:
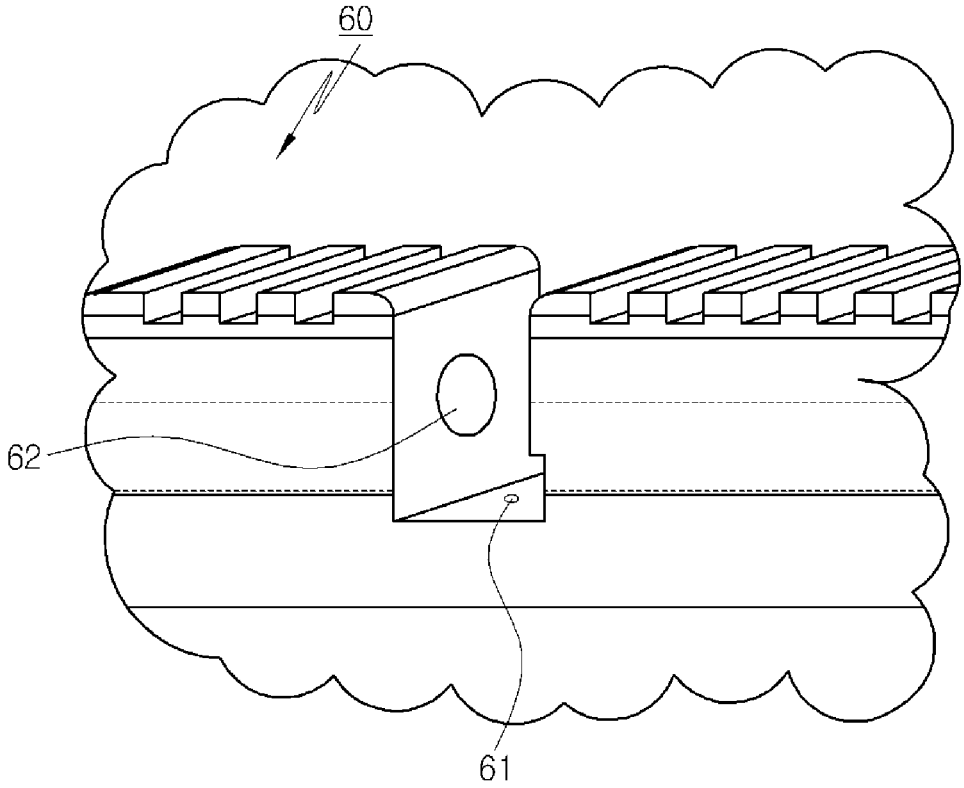
FIG. 4 is a view showing a magazine combining part of a rifle body of the split type magazine of the air rifle according to the present invention.

FIG. 2 is an exploded view of a magazine body having a lock unit for preventing rotation of a pellet rotating and conveying unit of a split type magazine of an air rifle according to the present invention, and for your understanding, illustrates a breechblock, which does not fall into the category of the present invention, FIG. 3 is an exploded view of a magazine fixing block, and FIG. 4 is a view showing a part where the magazine fixing block of the present invention is attached to a magazine combining part of a rifle body.

The split type magazine 10 of an air rifle according to the present invention is greatly divided into two parts: one being a magazine body 10 and the other being a magazine fixing block 50.

Hereinafter, the split type magazine 10 of an air rifle according to the present invention will be described in more detail. First, the magazine body is as follows.

A magazine case 11 is formed in a cylindrical shape and a plurality of screw holes 12 are formed at both ends. A pellet rotating and conveying lock unit which has a pellet rotating and conveying fixing pin 17 pressed by a slide lock button 15 and a spring 16 elastically supported by a spring 13 and a ball 14 is assembled to a space part formed at the front. The spring 13 and the ball 14 clicks when the slide lock button 15 moves from side to side to be locked. An insertion groove 18 which is inserted into a ball 51 of the pellet fixing block 50 is formed at a lower end portion.

A left side plate 20 has a plurality of holes 22 formed to be joined to the left side of the magazine case 11 by a plurality of joining bolts 21. A magazine fixing shaft 23 is formed at one side of the left side plate 20, and a protrusion part 24 is formed at a lower end portion of the magazine fixing shaft 23. A polygonal head part 25 is formed at an end of the magazine fixing shaft 23, and a screw 26 is formed at the right end of the magazine fixing shaft 23. An inverted U-shaped groove 27 is formed at a lower end of the left side plate 20. A breechblock 28 can advance into the inverted U-shaped groove 27 and retreat from the inverted U-shaped groove 27.

Moreover, the left side plate 20 has a slide lock unit covering part 29. The left side plate 20 is attached to the magazine case 11 by the bolts 21.

The dotted circle in FIG. 2 is a cross sectional view of a pellet rotating and conveying unit 30.

The pellet rotating and conveying unit 30 includes: a boss part 32 and a protrusion part 38 which are fit and inserted into the magazine fixing shaft 23 of the left side plate 20; and a spring support hole 33 perforated in the boss part 32. The first part of a spring 48 is fit into the spring support hole 33. A plurality of pellet insertion holes 34 to which a plurality of pellets can be loaded are formed in the outer circumferential surface of the pellet rotating and conveying unit 30, and outer circumferential parts 35 of the pellet insertion holes 34 are opened.

A right side plate 31 is attached to the right of the magazine case 11 by the bolts 21 through the screw holes 12 of the magazine case 11. The right side plate 31 includes a slide lock unit covering part 29 formed at the front side thereof for covering the pellet rotating and conveying lock unit, and an insertion groove 18 which is formed at a lower end portion thereof to be inserted into the pellet fixing block 50. A right side inner plate 36 is assembled to an opening 37 of the right side plate 31.

The right side inner plate 36 is inserted into the opening 37 of the right side plate 31, and includes: an inverted 'U'-shaped opening part 39 formed at a lower end portion thereof; a boss part 40 formed at the left side thereof; and a counter sink hole 41 formed at the right side thereof. The boss part 40 is fit into a right end hole of the pellet rotating and conveying unit 30.

A pellet rotating shaft fixing member 44 has a screw hole 43 formed at an end portion of a middle part thereof and a recess formed at the other end portion thereof to be fit to the polygonal head part 25 of the left side plate 20.

The magazine rotary shaft fixing member 44 has a hole 45 perforated at a small diameter part thereof, and a spring 46 and a ball 47 are inserted into the hole 45. The ball 47 pressed to the spring 46 serves as a bearing. The magazine rotary shaft fixing member 44 is fit to the counter sink hole 41 of the right inner plate 36 and is fixed by a bolt 49.

An end of the spring 48 is fixed to the spring support hole 33 of the boss part 32 of the pellet rotating and conveying unit 30, and the other end is fixed to a spring support hole 42 formed in the magazine rotary shaft fixing member 44. A plurality of spring support holes 42 are formed in the magazine rotary shaft fixing member 44 to control elasticity of the spring 48.

The spring 48 serves to make the pellet rotating and conveying unit 30 rotate with elasticity. In this instance, when the pellet rotating and conveying unit 30 rotates, the protrusion part 38 formed on the pellet rotating and conveying unit 30 and the protrusion part 24 formed on the left side plate 20 come into contact with each other so that the pellet rotating and conveying unit 30 rotates just at a predetermined angle.

When the pellet rotating and conveying unit 30 rotates, the right inner plate 36 rotates together with the pellet rotating and conveying unit 30. In this instance, the magazine rotary shaft fixing member 44 does not rotate because the polygonal head part 25 of the left side plate 20 is combined with the recess of the magazine rotary shaft fixing member 44 and the bolt 49 is fixed to the screw 26.

The bolt 49 fixes the magazine rotary shaft fixing member 44 to the screw 26 of the magazine fixing shaft 23 of the left side plate 20.

Hereinafter, the magazine fixing block 50 will be described as follows.

The magazine fixing block 50 has balls 51 which are respectively disposed at both sides thereof and are elastically supported by a spring to be inserted into the insertion groove 18 of the magazine case 11. The ball 51 is mounted to slightly protrude out from the side wall of the magazine fixing block 50. When the user presses down the magazine case 11, the insertion groove 18 presses the ball 51, and the ball 51 is elastically retreated by the spring. When the user presses more down the magazine case 11, the ball 51 is fit into the insertion groove 18 to support the insertion groove 18.

The magazine fixing block 50 has a plurality of holes 53 formed to be attached to a magazine fixing part of a machine part 61 using a plurality of bolts 52. The magazine fixing block 50 has a pole index 55 which is fixed by a pin 54 and is assembled to a middle part thereof. The pole index 55 has an oval-shaped hole 56.

A spring 59 is supported in a hole, which is transversely formed in the magazine fixing block 50, by a fixing bolt 57, and one end of the spring 59 elastically supports the pole index 55 in the transverse direction.

The pole index 55 is elastically supported by the spring 58 in the upward direction.

The pole index 55 fixed by the pin 54 is assembled to the middle part of the magazine fixing block 50. When the breechblock 28 pushes down the middle part of the pole index 55, the pole index 55 advances in the clockwise direction so as to be in a next lock waiting state of the pellet rotating and conveying unit 30. In this instance, in a case that there is a pellet, an upper wind 71 of the magazine fixing block 50 serves to fix the pellet to prevent the pellet from going over. The split type magazine is operated by repeating the above movements.

In order to fix the magazine fixing block 50, the machine part 60 has two screw holes 61, and the magazine fixing block 50 is fixed when the bolts 52 are inserted into the screw holes 61.

The machine part 60 has a pellet loading hole 62, and the pellet is loaded on the pellet loading hole 62 by the breechblock 28.

An assembling process of the components of the split type magazine for the air rifle according to the present invention will be described.

In a state where the left side plate 20 gets in contact with the right side of the magazine case 11, the four bolts 21 are inserted and fixed in order. The first part of the spring 48 is fit into the spring hole 33 of the pellet rotating and conveying unit 30, and then, the pellet rotating and conveying unit 30 and the spring 48 are fit to the magazine fixing shaft 23 of the left side plate 20.

Next, the spring 13 is put into the hole formed in the front side of the magazine case 11 and the ball 14 is put into the hole, and then, the slide lock button 15 is pushed into the groove sideways. The pellet rotating and conveying fixing pin 17 pressed by the spring 16 is assembled.

In the above state, the right side plate 30 is fixed to the holes 12 of the magazine case 11 using the four bolts 21.

Next, the right inner plate 36 is adjusted to the magazine case 11, and then, is fixed by the four bolts 21. At the same time, the boss part 40 of the right inner plate 36 is fit into the hole of the pellet rotating and conveying unit 30.

Continuously, after the spring 46 and the ball 47 are put into the hole 42 of the magazine rotary shaft fixing member 44, one end portion of the spring 48 is fit into the hole 42, and then, is inserted into the hole of the right inner plate 36.

After that, the bolt 49 is coupled to the screw 26 formed on the magazine fixing shaft 23 of the left side plate 20. Then, the assembly of the split type magazine is finished.

After that, an assembling process of the magazine fixing block 50 will be described.

The springs and the balls 51 are inserted into the transverse holes formed at both ends of the magazine fixing block 50, and then, are fit into the holes not to get out of the holes by making entrances of the transverse holes get narrower. The balls 51 partly protrude from both sides of the magazine fixing block 50. When the user presses down the magazine case 11, the insertion groove 18 of the magazine case 11 presses the balls 51 so that the balls 51 moves inwardly by elasticity of the spring. When the user presses down the magazine case 11 more, the balls 51 are elastically supported to the insertion groove 18 so that the magazine case 11 is snap-fixed to the magazine fixing block 50.

After the pin 54 is inserted into the hole formed at the side of the magazine fixing block 50, the pole index 55 having the oval-shaped hole 56 is rotatably fixed, and then, the spring 59 is put into a hole 70 and the bolt 57 is assembled to the hole. The spring 58 is inserted into the bottom side of the pole index 55.

The assembled magazine fixing block 50 is inserted into a recess of the machine part 60, and then, is firmly fastened in the recess of the machine part 60 by the bolt 52.

A method to insert a pellet into the magazine will be described.

First, put the slide lock button 15 at a lock position.

Second, rotate the right inner plate 36 in the clockwise direction to the finish.

Third, in the above state, insert pellets into the pellet insertion holes 34 one by one while rotating the right inner plate 36 in the counter clockwise direction.

Fourth, insert and fix into the magazine fixing block 50.

Fifth, put the slide lock button 15 at a lock release position.

Sixth, retreat the breechblock 28, and then, push the breechblock 28 forward so that a single shot of the pellet is loaded in a chamber.

In this instance, when the breechblock 28 pushes down the middle part of the pole index 55, the pole index 55 advances in the clockwise direction so that the pellet rotating and conveying unit 30 is in the next lock waiting state. In this instance, in the case that there is a pellet, the upper wind 71 of the magazine fixing block 50 serves to fix the pellet to prevent the pellet from going over.

What is claimed is:

1. A split type magazine of an air rifle comprising:

a magazine case formed in a cylindrical shape and comprising an insertion groove formed in a lower end portion thereof configured to be fit to a magazine fixing block, and a plurality of screw holes perforated at both sides;

a left side plate comprising a plurality of holes to which bolts for fixing the magazine case are inserted, a magazine fixing shaft formed at one side thereof, a protrusion part formed at a lower end portion of the magazine fixing shaft, a polygonal head part formed at an end of the magazine fixing shaft, a screw formed at an end portion of the magazine fixing shaft, and an inverted U-shaped groove formed at a lower end thereof;

a pellet rotating and conveying unit comprising a boss part and a protrusion part inserted into the magazine fixing shaft of the left side plate, a spring support hole perforated in the boss part, a plurality of pellet insertion holes on which a plurality of pellets are loadable and of which outer circumferential parts are opened;

a right side plate attached by a plurality of bolts through the screw holes of the magazine case and comprising a part formed at a front side thereof to cover a magazine fixing pin slide lock insertion part, an insertion groove formed at a lower end portion thereof and configured to fit to the magazine fixing block, and a circular opening formed at a middle part thereof;

a right inner plate configured to be inserted into an opening of the right side plate and comprising a boss part formed at a left side thereof, a counter sink hole formed at a right side thereof, and an inverted U-shaped groove formed at a lower end thereof;

a magazine rotary shaft fixing member configured to fit to the counter sink hole of the right inner plate and comprising a hole perforated at a small diameter part thereof, a spring and a ball inserted into the hole, a screw hole formed in a middle part thereof, and a recess formed in the middle part thereof configured to be fit to the polygonal head part of the left side plate;

a spring with a first end fixed to the spring support hole of the boss part of the pellet rotating and conveying unit and a second end fixed to the hole formed in the magazine rotary shaft fixing member;

a bolt to fix the magazine rotary shaft fixing member to the screw of the magazine fixing shaft of the left side plate; and a magazine fixing block comprising balls which are respectively disposed at both sides thereof and elastically supported by a spring configured to be inserted into the insertion groove of the magazine case, a plurality of bolts configured to be inserted into a plurality of holes formed in a magazine fixing part of a machine part to attach the magazine fixing block to an engine part, and a pole index fixed and assembled to a middle part thereof by a pin.

2. The split type magazine according to claim 1, wherein the magazine case comprises the pellet rotating and conveying unit which is disposed at a front thereof and to which a pellet rotating and conveying unit fixing pin pressed by a slide lock button and a spring elastically supported by a spring and a ball is assembled.

3. The split type magazine according to claim 1, wherein the magazine rotary shaft fixing member comprises a plurality of spring fixing holes to control elasticity of the spring.

4. The split type magazine according to claim 1, wherein the pole index advances in a clockwise direction in response to a breechblock pushing down on a middle part of the pole index to a next lock waiting state of the pellet rotating and conveying unit; and wherein an upper wind of the magazine fixing block fixes a pellet therein to prevent the pellet from going over.

* * * * *